US012607141B2

(12) United States Patent
Osada et al.

(10) Patent No.: US 12,607,141 B2
(45) Date of Patent: Apr. 21, 2026

(54) EXHAUST GAS TREATMENT EQUIPMENT

(71) Applicant: ISUZU MOTORS LIMITED, Yokohama (JP)

(72) Inventors: Katsushi Osada, Fujisawa (JP); Shoki Ishikawa, Fujisawa (JP)

(73) Assignee: ISUZU MOTORS LIMITED, Yokohama (JP)

( * ) Notice: Subject to any disclaimer, the term of this patent is extended or adjusted under 35 U.S.C. 154(b) by 0 days.

(21) Appl. No.: 19/095,873

(22) Filed: Mar. 31, 2025

(65) Prior Publication Data

US 2025/0347242 A1 Nov. 13, 2025

(30) Foreign Application Priority Data

May 9, 2024 (JP) ..... 2024-076597

(51) Int. Cl.
*F01N 3/28* (2006.01)
*F01N 3/20* (2006.01)

(52) U.S. Cl.
CPC ..... *F01N 3/28* (2013.01); *F01N 3/208* (2013.01)

(58) Field of Classification Search
CPC ..... F01N 3/28; F01N 3/208; F01N 2240/20; F01N 2610/102; F01N 3/2066; F01N 3/2892; F01N 2610/02; Y02T 10/12
See application file for complete search history.

(56) References Cited

U.S. PATENT DOCUMENTS 8,033,104 B2 * 10/2011 Zhang ..... F01N 3/36 60/303
8,621,846 B2 * 1/2014 Thomas ..... B01F 25/4315 60/303
8,726,643 B2 * 5/2014 Way ..... F01N 13/18 60/303
8,800,276 B2 * 8/2014 Levin ..... B01F 25/4314 60/303
9,784,163 B2 * 10/2017 Noren, IV ..... B01F 25/10
10,179,315 B2 * 1/2019 Brandl ..... B01F 25/3141
10,215,076 B2 * 2/2019 Solipuram ..... F01N 13/1872
10,704,448 B2 * 7/2020 Wang ..... B01F 25/3141
11,161,080 B2 * 11/2021 Kurpejovic ..... B01F 23/2132
(Continued)

FOREIGN PATENT DOCUMENTS

CN 107869376 B * 7/2020 ..... F01N 3/2892
JP 2017-172332 A 9/2017

*Primary Examiner* — Jesse S Bogue
(74) *Attorney, Agent, or Firm* — PROCOPIO, CORY, HARGREAVES & SAVITCH LLP

(57) ABSTRACT

An exhaust gas treatment equipment includes an exhaust passage through which exhaust gas flows, an injection unit that injects urea water into the exhaust passage, an inclined plate that is disposed within the exhaust passage and is inclined with respect to a virtual plane orthogonal to an injection direction in which the injection unit injects urea water, and an opposing plate provided downstream of the inclined plate in the exhaust passage so as to face the inclined plate and, together with the inclined plate, forms an injection space into which the urea water is injected. The inclined plate includes a convex portion that is formed on a facing surface that faces the injection unit and onto which the urea water is injected, and a concave portion that is formed on a back surface opposite to the facing surface and serves as a flow path for the exhaust gas.

10 Claims, 7 Drawing Sheets

(56) References Cited

U.S. PATENT DOCUMENTS

| | | | | |
|---|---|---|---|---|
| 11,187,132 | B2 * | 11/2021 | Wang | B01F 25/4332 |
| 11,278,850 | B2 * | 3/2022 | Kurpejovic | B01F 25/4233 |
| 2012/0144812 | A1 * | 6/2012 | Hyun | B01F 25/25<br>60/301 |
| 2015/0110681 | A1 * | 4/2015 | Ferront | B01F 23/2132<br>422/168 |
| 2017/0089246 | A1 * | 3/2017 | Greber | F01N 3/2073 |

* cited by examiner

EXHAUST GAS TREATMENT EQUIPMENT

CROSS-REFERENCE TO RELATED APPLICATIONS

The present application claims priority to Japanese Patent Application number 2024-76597, filed on May 9, 2024 contents of which are incorporated herein by reference in their entirety.

The present disclosure relates to exhaust gas treatment equipment for purifying exhaust gas. Japanese Unexamined Patent Application Publication No. 2017-172332 discloses an engine in which an impingement body having an impingement surface, on which urea water injected by an injection unit collides, is provided in an exhaust passage. The engine includes a heater for heating the impingement surface to evaporate and decompose the urea water to produce ammonia.

However, in the above configuration, it is necessary to apply electrical current between the heater and the impingement surface, resulting in a complex structure. Furthermore, in the above configuration, since the urea water tends to mix with the exhaust gas before reaching the impingement body, it becomes difficult for the urea water to come into contact with the impingement surface.

BRIEF SUMMARY OF THE INVENTION

In view of these issues, the present disclosure aims to promote evaporative decomposition of urea water with a simple structure.

A first aspect of the present disclosure provides exhaust gas treatment equipment including: an exhaust passage through which exhaust gas flows; an injection unit that injects urea water into the exhaust passage; an inclined plate that is disposed within the exhaust passage and is inclined with respect to a virtual plane orthogonal to an injection direction in which the injection unit injects the urea water; and an opposing plate that is provided downstream of the inclined plate in the exhaust passage so as to face the inclined plate and, together with the inclined plate, forms an injection space into which the urea water is injected, wherein the inclined plate includes: a convex portion that is formed on a facing surface that faces the injection unit and onto which the urea water is injected; and a concave portion that is formed on a back surface opposite to the facing surface and serves as a flow path for the exhaust gas.

DETAILED DESCRIPTION OF THE INVENTION

Hereinafter, the present disclosure will be described through exemplary embodiments, but the following exemplary embodiments do not limit the disclosure according to the claims, and not all of the combinations of features described in the exemplary embodiments are necessarily essential to the solution means of the disclosure.

Configuration of Exhaust Gas Treatment Equipment

Figure 1:
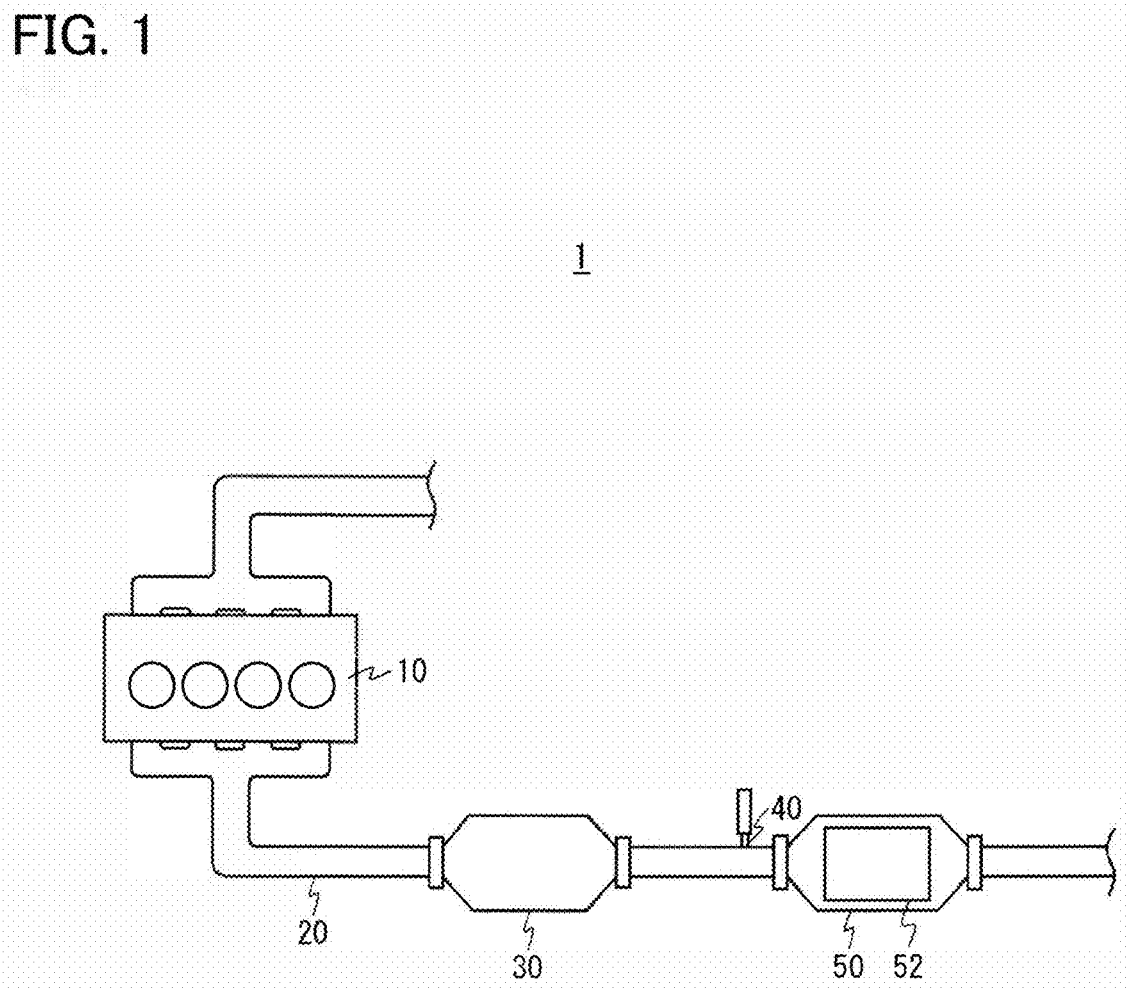
FIG. 1 is a schematic diagram illustrating a configuration of exhaust gas treatment equipment 1 according to one embodiment.

FIG. 1 is a schematic diagram illustrating a configuration of exhaust gas treatment equipment 1 according to one embodiment. As shown in FIG. 1, the exhaust gas treatment equipment 1 includes an engine 10, an exhaust passage 20, a diesel particulate filter (DPF) 30, an injection unit 40, and a selective catalytic reduction (SCR) device 50. The exhaust gas treatment equipment 1 is mounted in a vehicle such as a truck and purifies exhaust gas from the engine 10.

The engine 10 is an internal combustion engine that generates power by combusting a mixture of fuel and intake air (air) and expanding the resulting gases. The engine 10 is, for example, a diesel engine, but is not limited thereto.

The exhaust passage 20 is an exhaust pipe connected to the engine 10, and emits exhaust gas from the engine 10. The exhaust passage 20, through which the exhaust gas flows, is provided with the DPF 30, the injection unit 40, and the SCR device 50.

The DPF 30 is a filter that captures particulate matter (PM) contained in the exhaust gas. The DPF 30 is formed of, for example, a honeycomb body made of metal or ceramics, and captures PM through pores and on the surface of partition walls.

The injection unit 40 is provided between the DPF 30 and the SCR device 50, and injects urea water into the exhaust passage 20. The urea water injected by the injection unit 40 is evaporated and decomposed by the heat of the exhaust gas flowing through the exhaust passage 20, thereby generating ammonia. Ammonia is used to facilitate a reduction reaction of NOx in the exhaust gas. Although details will be described later, a configuration for promoting the evaporative decomposition of urea water is provided around the injection unit 40 in the exhaust passage 20.

The SCR device 50 is a device that converts NOx in exhaust gas into harmless nitrogen by a reduction reaction. The SCR device 50 includes a reduction catalyst 52 that promotes the reduction reaction between ammonia and NOx. Ammonia generated from the urea water is adsorbed onto the reduction catalyst 52. The reduction catalyst 52 reduces NOx to nitrogen and water using the adsorbed ammonia, thereby reducing NOx emissions.

<Configuration Around the Injection Unit>

A configuration around the injection unit 40 in the exhaust passage 20 will be described with reference to FIGS. 2 to 7.

Figure 2:
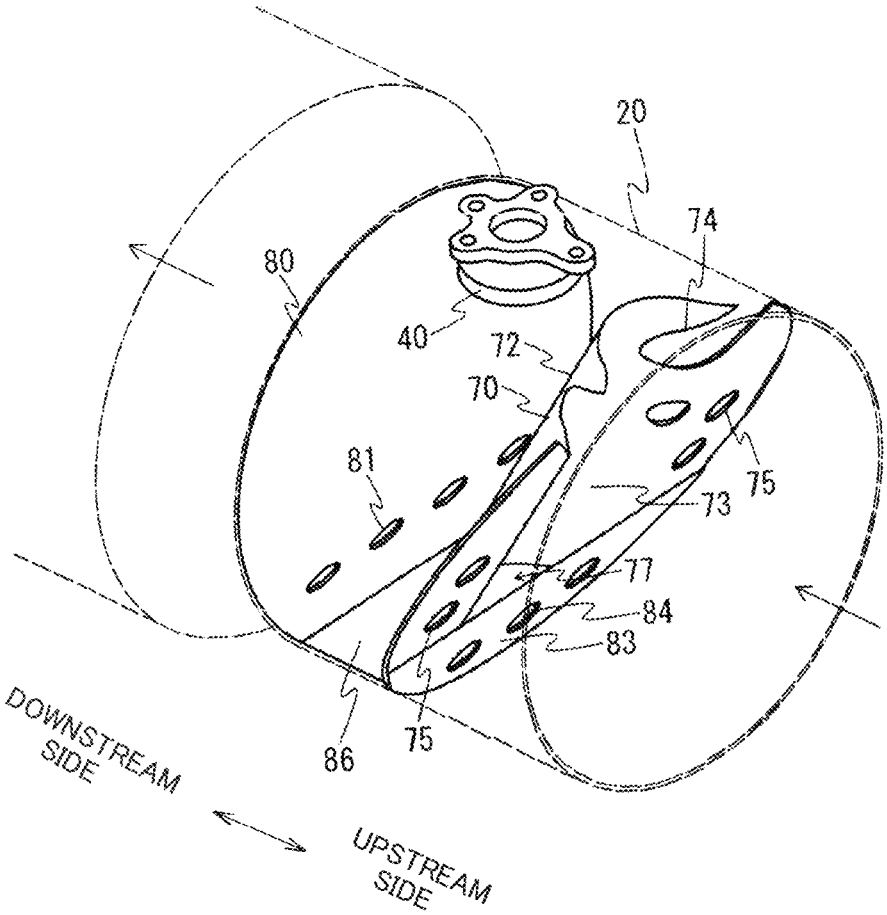
FIG. 2 is a schematic diagram illustrating a configuration around an injection unit 40 in an exhaust passage 20.
Figure 3:
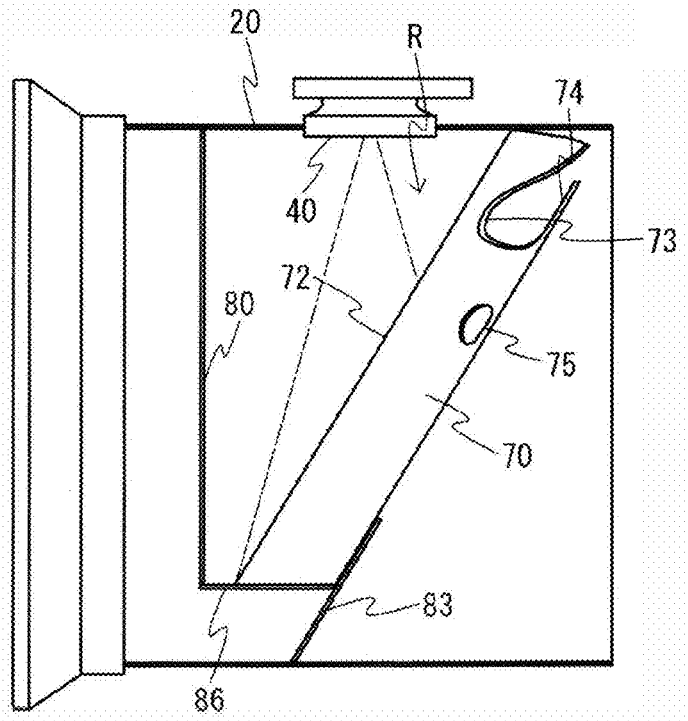
FIG. 3 is a schematic diagram of the internal configuration of FIG. 2 as seen from the front.
Figure 4:
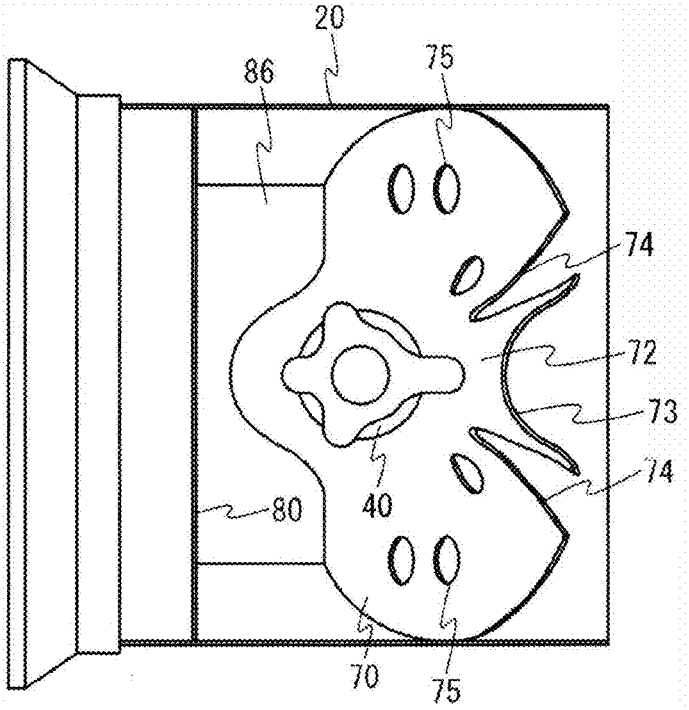
FIG. 4 is a schematic diagram of the internal configuration of FIG. 2 as seen from above.
Figure 5:
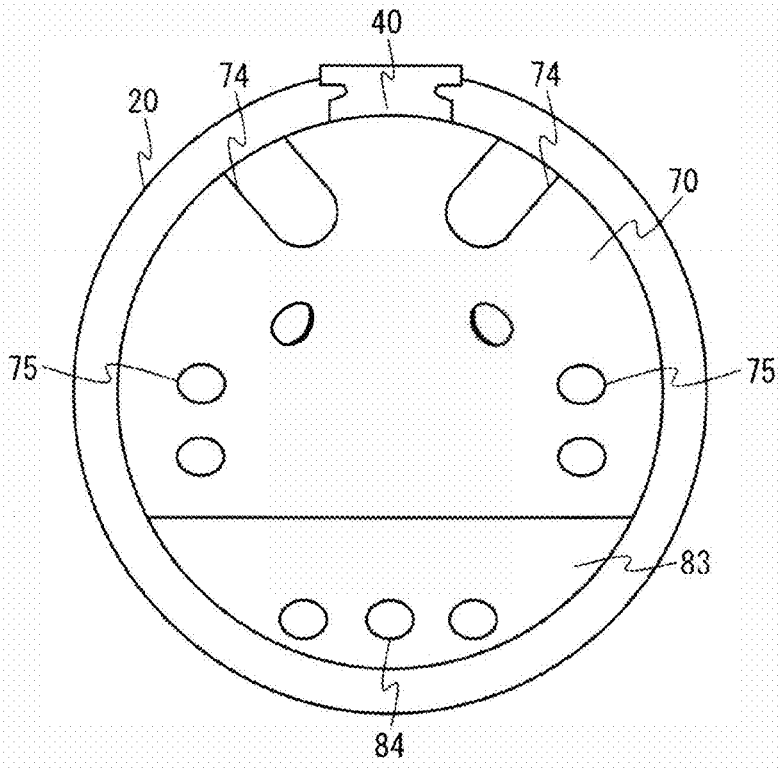
FIG. 5 is a schematic diagram of the internal configuration of FIG. 2 as seen from the right side.
Figure 6:
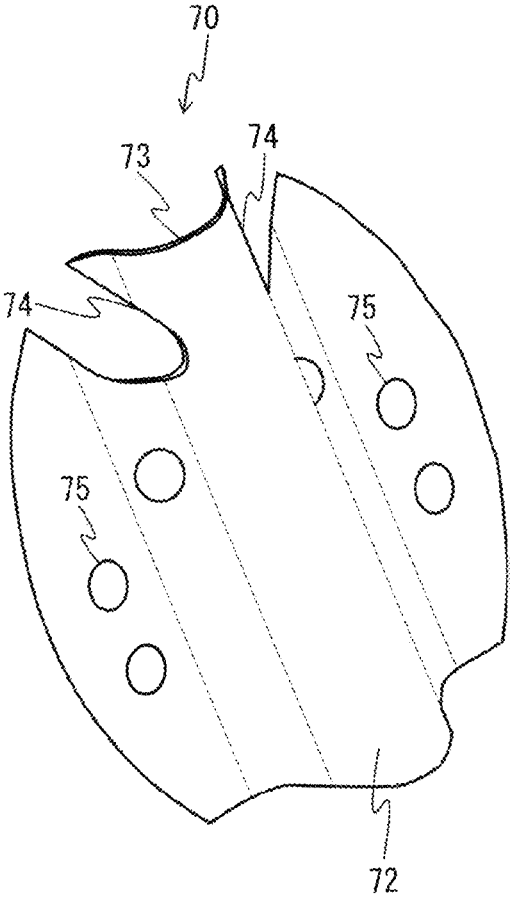
FIG. 6 is a perspective view showing an inclined plate 70.
Figure 7:
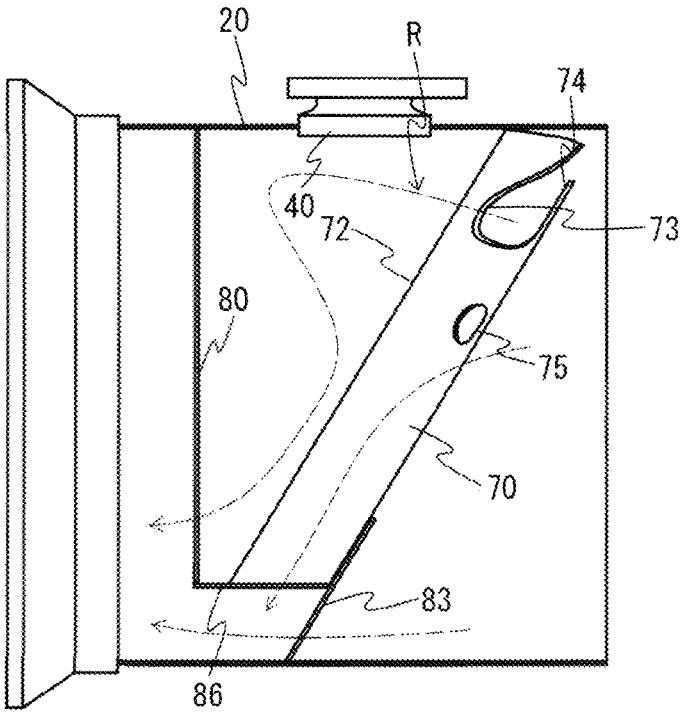
FIG. 7 is a schematic diagram illustrating the flow of exhaust gas.

FIG. 2 is a schematic diagram illustrating the configuration around the injection unit 40 in the exhaust passage 20. FIG. 3 is a schematic diagram of the internal configuration of FIG. 2 as seen from the front. FIG. 4 is a schematic diagram of the internal configuration of FIG. 2 as seen from above. FIG. 5 is a schematic diagram of the internal configuration of FIG. 2 as seen from the right side. FIG. 6 is a perspective view showing an inclined plate 70. FIG. 7 is a schematic diagram illustrating the flow of exhaust gas. In FIG. 2, for ease of explanation, the exhaust passage 20 surrounding the inclined plate 70, an opposing plate 80, a connecting plate 83, and a lower plate 86 is indicated by a broken line. In addition, the area enclosed by two broken lines in FIG. 3 indicates the range in which the injection unit 40 injects urea water. In FIG. 7, the flow of the exhaust gas is indicated by broken lines.

In the present embodiment, a plurality of plates are provided in a lower portion of the injection unit 40 in the exhaust passage 20 in order to promote the evaporative decomposition of the urea water injected by the injection unit 40. Specifically, as shown in FIGS. 2 and 3, the inclined plate 70, the opposing plate 80, the connecting plate 83, and the lower plate 86 are provided at the lower portion of the injection unit 40.

As shown in FIG. 3, the inclined plate 70 is positioned in the exhaust passage 20 at the injection target of the urea water from the injection unit 40. Therefore, the urea water injected by the injection unit 40 adheres to the surface of the inclined plate 70 that faces the injection unit 40. As shown in FIG. 2, the inclined plate 70 is shaped to block the exhaust passage 20 from the inside. Specifically, a portion of the outer peripheral surface of the inclined plate 70 is in contact with the inner wall surface of the exhaust passage 20. Therefore, the reverse surface of the inclined plate 70 tends to be warmed by the exhaust gas. The inclined plate 70 includes at least one hole portion that allows the exhaust gas to pass through. As shown in FIG. 3, the lower portion of the inclined plate 70 is spaced apart from the inner wall surface of the exhaust passage 20.

As shown in FIG. 3, the inclined plate 70 is provided in an inclined state within the exhaust passage 20. Specifically, in the exhaust passage 20, the inclined plate 70 is inclined with respect to a virtual plane orthogonal to an injection direction in which the injection unit 40 injects the urea water (since the injection direction is vertically downward, this virtual plane is a horizontal plane). In this way, the urea water injected by the injection unit 40 easily adheres to a wide area of the inclined plate 70. Additionally, since the inclined plate 70 is inclined, the urea water injected by the injection unit 40 readily adheres to the inclined plate 70, even when the inclined plate 70 in is positioned below the injection unit 40.

The inclined plate 70 has a shape formed by processing a flat plate. As shown in FIG. 6, the inclined plate 70 has a symmetrical shape. The inclined plate 70 includes a convex portion 72, a concave portion 73, and inflow hole portions 74 and 75.

As shown in FIG. 3, the convex portion 72 is formed on a facing surface of the inclined plate 70 that faces the injection unit 40. The convex portion 72 is a region where the injected urea water adheres. The convex portion 72 is formed near the center of the inclined plate 70. Specifically, as shown in FIG. 6, the convex portion 72 extends from the lower portion to the upper portion near the center of the inclined plate 70. The convex portion 72 has a curved surface, with the entire central region of the facing surface being curved. Here, as shown in FIG. 4, the convex portion 72 is positioned directly below the injection unit 40. By providing the convex portion 72 in this shape on the facing surface, the surface area where the urea water adheres on the facing surface increases.

The concave portion 73 is formed on the back surface opposite to the facing surface. The concave portion 73 forms a flow path for the exhaust gas. The exhaust gas that reaches the back surface of the inclined plate 70 flows along the concave portion 73. By having the exhaust gas flow along the concave portion 73, the flow of the exhaust gas becomes concentrated within the concave portion 73, causing the reverse surface of the inclined plate 70 to be heated to a high temperature. In this way, the urea water adhering to the convex portion 72 of the inclined plate 70 is evaporated and decomposed by the high temperature of the inclined plate 70, generating ammonia gas. As a result, urea water deposition without evaporative decomposition is suppressed, and clogging inside the exhaust passage 20 due to deposits is also prevented.

As shown in FIG. 6, the concave portion 73 is extends from the lower portion to the upper portion near the center of the back surface of the inclined plate 70. This causes the exhaust gas that reaches the back surface of the inclined plate 70 to flow from the upper portion toward the lower portion of the inclined plate 70. As a result, the exhaust gas remains in contact with the reverse surface of the inclined plate 70 for a longer duration, thereby promoting the evaporative decomposition of the urea water adhering to the convex portion 72 of the inclined plate 70.

The convex portion 72 and the concave portion 73 are formed by bending the flat plate. This facilitates the formation of the inclined plate 70, which includes the convex portion 72 and the concave portion 73. As shown in FIG. 6, the concave portion 73 is formed directly behind the convex portion 72. In this way, the heat of the exhaust gas flowing through the concave portion 73 is more easily transferred to the urea water adhering to the convex portion 72.

As shown in FIG. 6, the inflow hole portions 74 are holes provided in the upper portion of the inclined plate 70. Specifically, the inflow hole portions 74 are notches provided on both sides of the convex portion 72 in the inclined plate 70. The inflow hole portions 74 allow the exhaust gas to flow into an injection space R (a space enclosed by the inclined plate 70 and the opposing plate 80 as shown in FIG. 3) of the injection unit 40. That is, as shown in FIG. 7, part of the exhaust gas that reaches the inclined plate 70 passes through the inflow hole portions 74 and flows into the injection space R.

As shown in FIG. 6, the inflow hole portion 75 consists of holes formed on both sides of the convex portion 72 of the inclined plate 70. Specifically, a plurality of inflow hole portions 75 are formed so as to pass through a flat plate portion located on both sides of the convex portion 72. For example, the inflow hole portion 75 is a circular hole. Similarly to the inflow hole portions 74, the inflow hole portion 75 allows the exhaust gas to flow into the injection space R of the injection unit 40. Since the inflow hole portions 74 and 75 are located on both sides of the convex portion 72, the exhaust gas passing through the inflow hole portions 74 and 75 is less likely to contact the urea water injected by the injection unit 40. As a result, the urea water more easily adheres to the convex portion 72.

As shown in FIG. 3, the opposing plate 80 is provided downstream of the inclined plate 70 in the exhaust passage 20 so as to face the inclined plate 70. The opposing plate 80 is located downstream of the injection unit 40 in the exhaust passage 20. The opposing plate 80 and the inclined plate 70 together form the injection space R, into which the urea water is injected. The lower portion of the opposing plate 80 is spaced apart from the inner wall surface of the exhaust passage 20, similarly to the lower portion of the inclined plate 70.

The exhaust gas that has flowed into the injection space R between the opposing plate 80 and the inclined plate 70 warms the urea water injected by the injection unit 40. This promotes the evaporative decomposition of urea water. Additionally, the exhaust gas carries the ammonia gas, generated by the evaporative decomposition of urea water, toward the SCR device 50 downstream of the opposing plate 80.

The opposing plate 80 has a flat plate shape. Unlike the inclined plate 70, the opposing plate 80 is not inclined and is disposed straight in the vertical direction. As shown in FIG. 2, at least one outflow hole portion 81 is provided in the lower portion of the opposing plate 80. The outflow hole portion 81 is a hole that penetrates the opposing plate 80. For example, the outflow hole portion 81 is a circular hole. The outflow hole portion 81 allows the ammonia gas, generated from the urea water, and the exhaust gas to flow out of the injection space. This enables the ammonia gas and the exhaust gas to flow into the SCR device 50, which is located downstream of the exhaust passage 20, thereby purifying NOx in the exhaust gas.

Since the inflow hole portions 74 are located in the upper portion of the inclined plate 70 and the outflow hole portion 81 is located in the lower portion of the opposing plate 80, the exhaust gas that has flowed in through the inflow hole portions 74 travels a longer distance through the injection space, as shown in FIG. 7. As a result, the exhaust gas remains in the injection space for a longer duration. This allows for more efficient heating of the urea water by the exhaust gas and more effective transport of the ammonia gas by the exhaust gas.

As shown in FIG. 2, the connecting plate 83 is connected to the lower portion of the back surface of the inclined plate 70. Specifically, the connecting plate 83 is provided in parallel with the inclined plate 70, and is connected to both sides of the concave portion 73 of the inclined plate 70. The connecting plate 83 and the inclined plate 70 together form a space through which the exhaust gas flows (specifically, a gap 77 shown in FIG. 2). By providing the connecting plate 83, the exhaust gas flowing through the concave portion 73 more easily passes through the gap 77 and flows toward the space between the inclined plate 70 and the exhaust passage 20 (specifically, below the lower plate 86 shown in FIG. 7).

Here, the connecting plate 83 has a semicircular shape. As shown in FIG. 5, the lower portion of the connecting plate 83 is in contact with the inner wall surface of the exhaust passage 20. The connecting plate 83 is provided with at least one through hole portion 84, through which the exhaust gas flowing below the inclined plate 70 passes. The through hole portion 84 is formed in the lower portion of the connecting plate 83, below the lower plate 86, and is connected to the inner wall surface.

As shown in FIG. 3, the lower plate 86 is connected to the lower portion of the facing surface of the inclined plate 70 and the lower portion of the opposing plate 80. The lower plate 86 has a flat plate shape. Here, the lower plate 86 is provided perpendicular to the opposing plate 80. The lower plate 86, together with the inclined plate 70 and the opposing plate 80, forms the injection space R. With the lower plate 86 provided, the urea water injected by the injection unit 40 readily adheres to the upper surface of the lower plate 86. For example, the urea water that has flowed along the facing surface of the inclined plate 70 is more likely to remain on the upper surface of the lower plate 86.

As shown in FIG. 3, the lower plate 86 forms a gap between itself and the inner wall surface of the exhaust passage 20. Therefore, as shown in FIG. 7, the exhaust gas passes below the lower plate 86 (specifically, through the gap between the lower plate 86 and the inner wall surface of the exhaust passage 20). The urea water remaining on the upper surface of the lower plate 86 is evaporated and decomposed by the exhaust gas passing below the lower plate 86. As a result, it is possible to suppress the portion of the urea water injected by the injection unit 40 that remains without being evaporatively decomposed.

Although the lower plate 86 is provided in the above description, the present embodiment is not limited thereto. For example, when the lower portion of the inclined plate 70 is connected to the opposing plate 80, the lower plate 86 does not need to be provided. Additionally, although the connecting plate 83 is provided on the back surface of the inclined plate 70 in the present embodiment, the connecting plate 83 does not need to be provided.

Effects of the Embodiment

The exhaust gas treatment equipment 1 of the above-described embodiment includes, in the exhaust passage 20, the inclined plate 70 that is inclined with respect to the virtual plane orthogonal to the injection direction in which the injection unit 40 injects the urea water, and the opposing plate 80 that is provided downstream of the inclined plate 70 so as to face the inclined plate 70, forming, together with the inclined plate 70, the injection space in which the urea water is injected. The inclined plate 70 includes the convex portion 72 that is formed on the facing surface that faces the injection unit 40 and onto which the urea water is injected, and the concave portion 73, that is formed on the back surface opposite to the facing surface and serves as the flow path for the exhaust gas. By providing the convex portion 72 on the facing surface of the inclined plate 70, the surface area where the urea water injected by the injection unit 40 adheres to the facing surface increases. Additionally, by providing the concave portion 73 on the back surface of the inclined plate 70 to form the flow path for the exhaust gas, the flow of the exhaust gas becomes concentrated in the concave portion 73, making it easier to heat the concave portion 7. As a result, the evaporative decomposition of the urea water adhering to the convex portion 72 is enhanced. In particular, since a large amount of urea water is likely to adhere to the convex portion 72, enhancing the evaporative decomposition of urea water can be achieved with a simple structure.

The present disclosure is explained on the basis of the exemplary embodiments. The technical scope of the present disclosure is not limited to the scope explained in the above embodiments and it is possible to make various changes and modifications within the scope of the disclosure. For example, all or part of the apparatus can be configured with any unit which is functionally or physically dispersed or integrated. Further, new exemplary embodiments generated by arbitrary combinations of them are included in the exemplary embodiments. Further, effects of the new exemplary embodiments brought by the combinations also have the effects of the original exemplary embodiments.

What is claimed is:

1. Exhaust gas treatment equipment comprising:

an exhaust passage through which exhaust gas flows;

an injection unit that injects urea water into the exhaust passage;

an inclined plate that is disposed within the exhaust passage and is inclined with respect to a virtual plane orthogonal to an injection direction in which the injection unit injects the urea water; and an opposing plate that is provided downstream of the inclined plate in the exhaust passage so as to face the inclined plate and, together with the inclined plate, forms an injection space into which the urea water is injected, wherein the inclined plate includes:

a convex portion that is formed on a facing surface that faces the injection unit and onto which the urea water is injected; and a concave portion that is formed on a back surface opposite to the facing surface and serves as a flow path for the exhaust gas, wherein the inclined plate is disposed at least partially upstream of the injection unit.

2. The exhaust gas treatment equipment according to claim 1, wherein the concave portion is formed directly behind the convex portion.

3. The exhaust gas treatment equipment according to claim 1, wherein the convex portion is located directly below the injection unit.

4. The exhaust gas treatment equipment according to claim 1, wherein the convex portion and the concave portion are formed at the center of the inclined plate and extend from a lower portion to an upper portion.

5. The exhaust gas treatment equipment according to claim 1, wherein the convex portion and the concave portion are formed by bending a flat plate.

6. The exhaust gas treatment equipment according to claim 1, wherein a lower portion of the inclined plate is spaced apart from an inner wall surface of the exhaust passage, and the exhaust gas treatment equipment further comprises a connecting plate that is connected to the lower portion of the inclined plate and, together with the inclined plate, forms a space through which the exhaust gas flows.

7. The exhaust gas treatment equipment according to claim 1, wherein in an upper portion of the inclined plate, inflow hole portions are provided on both sides of the convex portion to allow the exhaust gas to flow into the injection space.

8. The exhaust gas treatment equipment according to claim 7, wherein in a lower portion of the opposing plate, an outflow hole portion is provided to allow ammonia gas, generated from the urea water, and the exhaust gas to flow out of the injection space.

9. The exhaust gas treatment equipment according to claim 1, wherein a lower portion of the inclined plate and a lower portion of the opposing plate are spaced apart from an inner wall surface of the exhaust passage, and the exhaust gas treatment equipment further comprises:

a lower plate that is connected to the lower portion of the inclined plate and the lower portion of the opposing plate and forms a gap between the lower plate and the inner wall surface.

10. The exhaust gas treatment equipment according to claim 9, further comprising:

a connecting plate that is connected to a lower portion of the back surface of the inclined plate and, together with the lower portion, forms a space through which the exhaust gas flows, wherein a through hole portion, through which the exhaust gas passes, is formed in a lower portion of the connecting plate located below the lower plate and connected to the inner wall surface.

* * * * *